US005535982A

United States Patent [19]

Zayic

[11] Patent Number: 5,535,982

[45] Date of Patent: Jul. 16, 1996

[54] TOOL FOR GUIDING RODS THROUGH CONCRETE TIE LOOPS

[76] Inventor: David A. Zayic, Rte. 1, Box 228, Waubun, Minn. 56589

[21] Appl. No.: 520,878

[22] Filed: Aug. 30, 1995

[51] Int. Cl.[6] ..... E04G 17/75; B25B 25/00

[52] U.S. Cl. ..... 249/213; 29/267; 249/215; 254/29 A

[58] Field of Search ..... 249/213, 215; 29/267; 254/29 A

[56] References Cited

U.S. PATENT DOCUMENTS

| | | | |
|---|---|---|---|
| 1,029,578 | 6/1912 | Ferrall et al. | 29/267 |
| 2,243,346 | 5/1941 | Kinninger | 254/29 A |
| 2,525,950 | 10/1950 | Saffioti | 249/213 |
| 2,646,703 | 7/1953 | Erbe | 249/213 |
| 3,411,742 | 11/1968 | McArdle | 249/215 |
| 3,680,835 | 8/1972 | Rose | 254/29 A |
| 3,756,562 | 9/1973 | Ward | 254/29 R |

*Primary Examiner*—James P. Mackey
*Attorney, Agent, or Firm*—Merchant & Gould

[57] ABSTRACT

A tool for guiding a rod through a tie loop that is extending through a slot in a concrete form. The tool includes a rod guiding member defining an elongated channel extending longitudinally between front and back ends of the rod guiding member. The front end of the rod guiding member is preferably tapered to form a tab member for inserting through the tie loop. The tool also preferably includes a handle connected to the rod guiding member for grasping the tool. When the rod is driven longitudinally through the channel of the rod guiding member while the tab member is inserted through the tie loop, the rod guiding member pivots causing the tab member to pull the tie loop completely through the slot in the concrete form thereby allowing the rod to be guided through the tie loop.

7 Claims, 3 Drawing Sheets

TOOL FOR GUIDING RODS THROUGH CONCRETE TIE LOOPS

FIELD OF THE INVENTION

The present invention relates generally to a construction tool. Specifically, the present invention relates to tools for guiding rods through the loops of concrete ties.

BACKGROUND OF THE INVENTION

Concrete walls are commonly constructed by pouring wet concrete between opposing front and back plywood forms and allowing the concrete to cure. After the concrete cures, the forms are removed.

An effective method of holding the forms together is to employ a tie and rod assembly. Tie and rod assemblies typically include a plurality of ties that extend between the front and back forms. The ties have looped ends which extend through slots in the front and back forms. The ties are held in place by rods that are passed through the looped ends of the ties along the exterior surfaces of the front and back forms. Contact between the rods and the exterior surfaces of the front and back forms prevents the looped ends of the ties from being pulled back through the slots in the front and back forms. In this manner, the ties hold the forms in place as wet concrete is poured between the forms. After the concrete has cured, the rods are removed from the looped ends of the ties thereby allowing the forms to be removed from the concrete wall. The ties are typically left within the wall while the looped ends extending out of the wall are typically broken off with a tool.

A problem with tie and rod assemblies is that it is often difficult to pass the rods through the looped ends of the ties. The problem is intensified around areas where structures such as framing for doors and windows, stops for plumbing and electrical lines, block-outs, end caps, and spacers are located between the forms. In these areas, the structures prevent the front and back forms from being drawn together thereby making it difficult to pull the end loops of the ties completely through the slots in the front and back forms. Because the end loops are only partially exposed, there is insufficient clearance to pass the rods through the end loops. The difficult process of trying to force the rods through the partially exposed tie loops is time consuming and results in increased construction costs. Additionally, ties are commonly broken or damaged while workers attempt to force rods through partially exposed looped ends. Damaged ties increase the likelihood of form blow out when concrete is poured between the forms.

SUMMARY OF THE INVENTION

The present invention relates to a tool for guiding a rod through a tie loop that is extending through a slot in a concrete form. Generally, the tool includes a rod guiding member defining an elongated channel extending longitudinally between front and back ends of the rod guiding member. The front end of the rod guiding member is preferably tapered to form a tab member for inserting through the tie loop. The tool also preferably includes a handle connected to the rod guiding member for grasping the tool.

In general operation, the tab member of the tool is inserted within a portion of a tie loop that is extending through a slot in a concrete form. As the tool is grasped by the handle, a rod is driven longitudinally through the channel of the tool toward the tapered member. As the rod moves through the channel, the tool pivots relative to the concrete form causing the tab member to pull the tie loop through the slot in the concrete form. When the rod closely approached the tab member, the tool is caused to snap down against the form such that the base of the tool is flush against the form and the rod has sufficient clearance to be easily moved through the channel and guided through the tie loop.

A variety of advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE INVENTION

Reference will now be made in detail to exemplary embodiments of the present invention which are illustrated in the accompanying drawings. Wherever possible, the same reference numbers will be used throughout the drawings to refer to the same or like parts.

Figure 1:
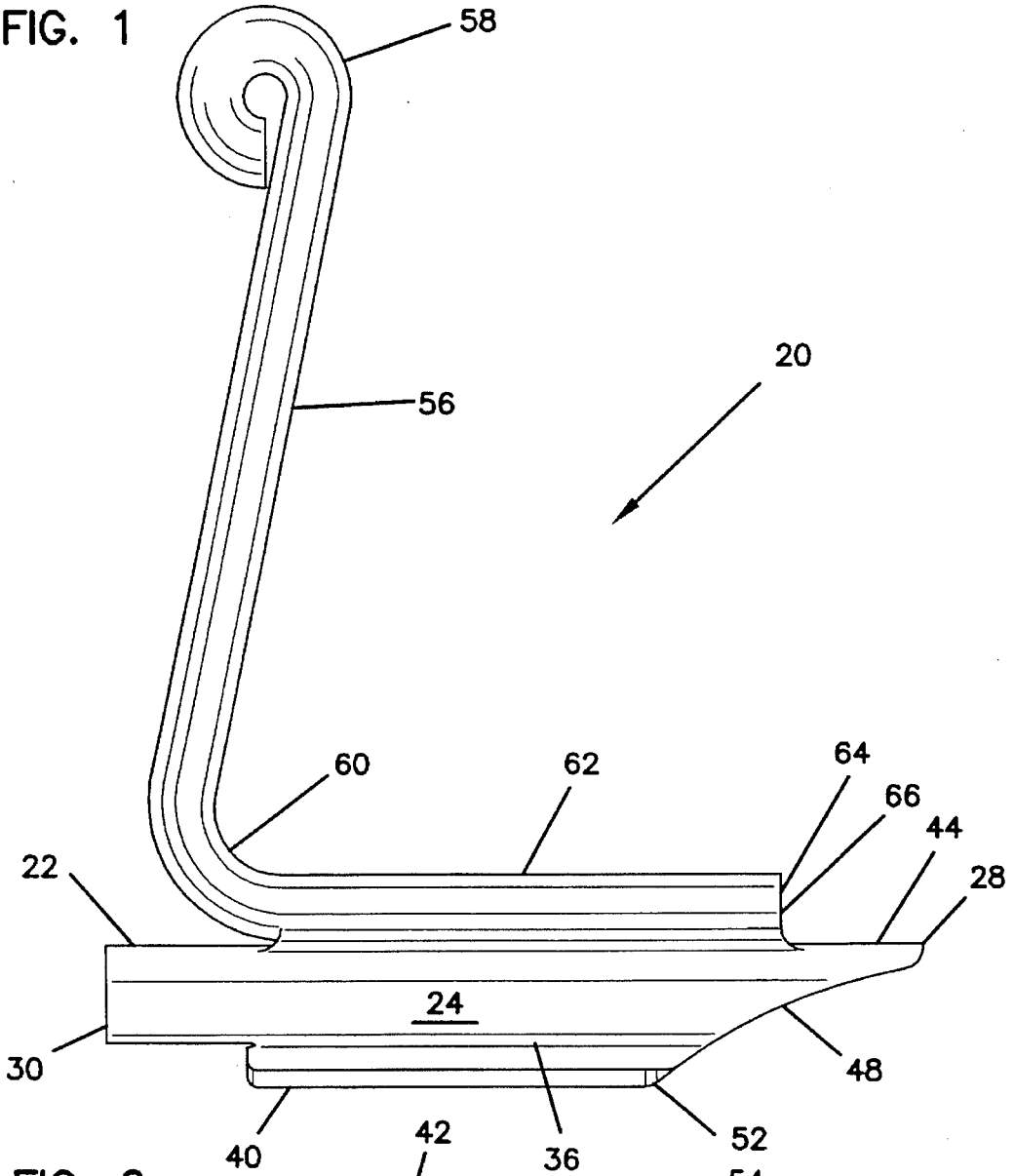
FIG. 1 is a side view of a tool constructed in accordance with the principles of the present invention.
Figure 2:
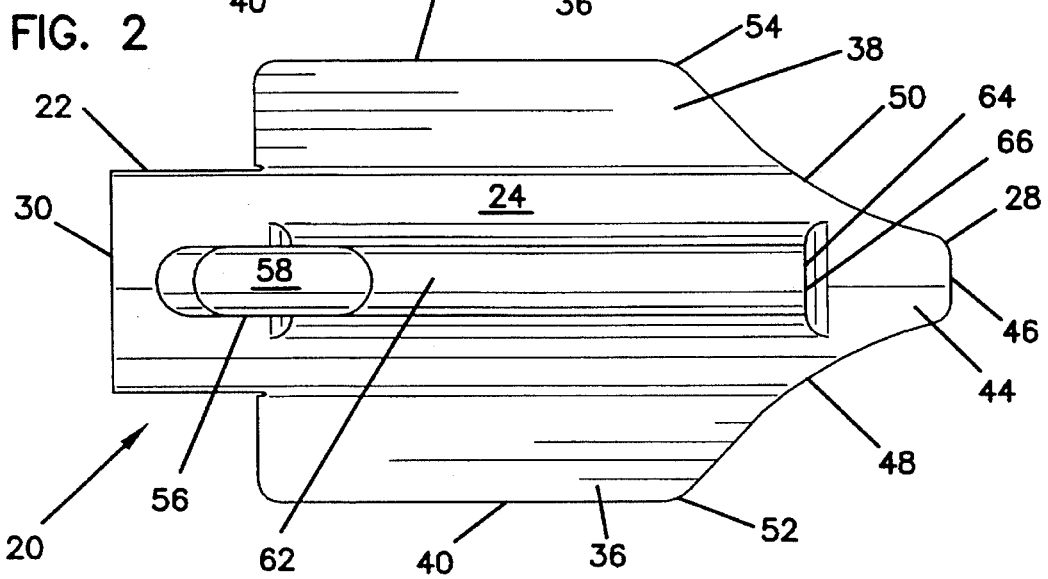
FIG. 2 is a top view of the tool of FIG. 1.
Figure 3:
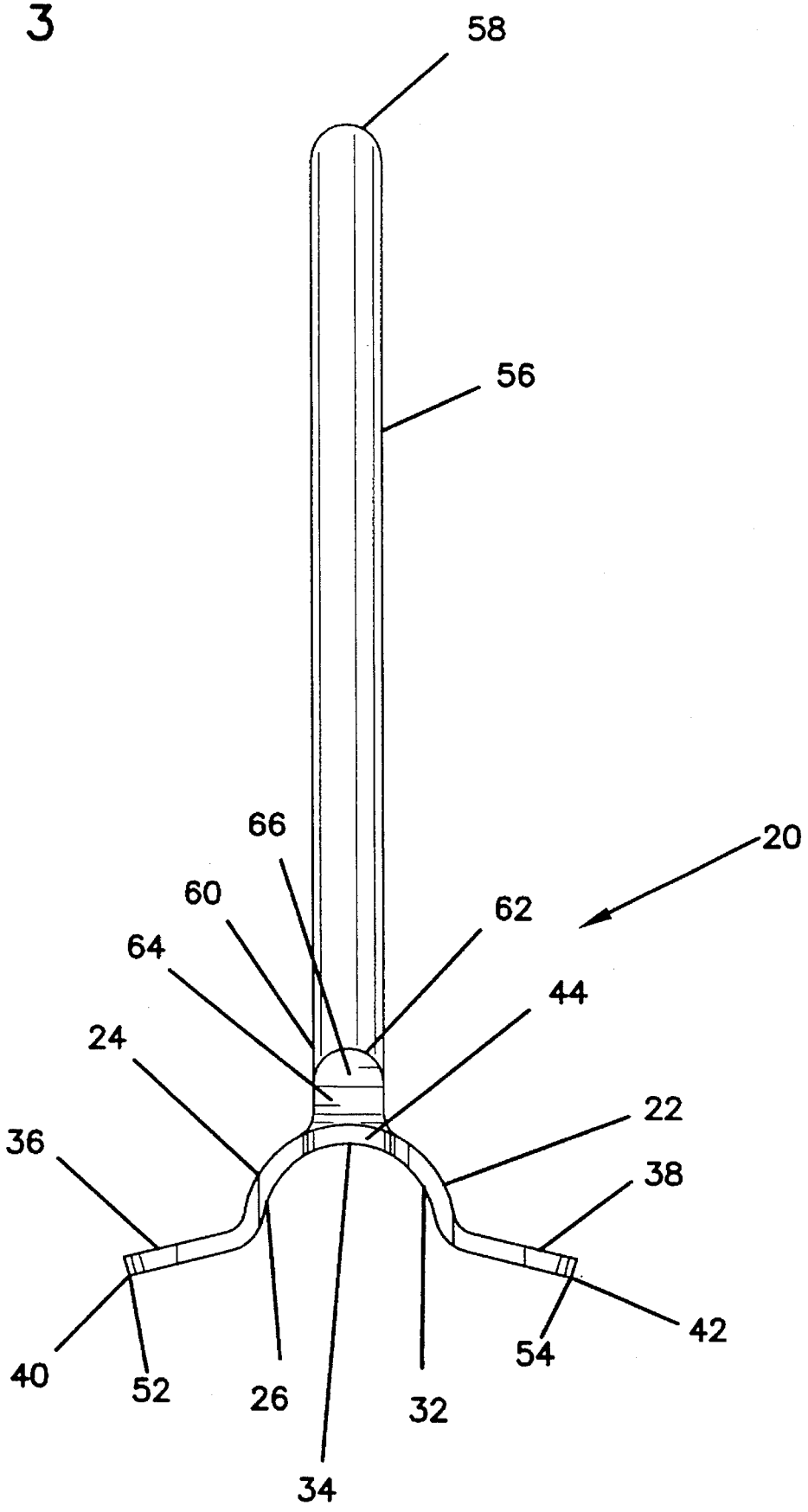
FIG. 3 is a front view of the tool of FIG. 1.

FIGS. 1–3 show a tool 20 which is a representative embodiment of the present invention. The tool 20 preferably includes an elongated rod guiding member 22 having outer and inner surfaces 24 and 26 that extend longitudinally between a front end 28 and a back end 30 of the elongated rod guiding member 22. The rod guiding member 22 preferably is a cylindrical pipe that is cut longitudinally in half such that the inner surface 26 forms an elongated rounded channel 32 that opens in a first direction. The channel 32 preferably has a deepest portion 34 located along a line extending longitudinally between the front and back ends 28 and 30 of the rod guiding member 22. The radial cross section of the channel 32 is preferably sized to allow a rod to be longitudinally moved through the channel 32 from the front end 28 to the back end 30 of the rod guiding member 22.

The tool 20 also preferably includes first and second wings 36 and 38 flaring from opposite sides of the channel 32. The wings 36 and 38 are inclined slightly in the first direction such that the overall depth of the channel 32 is increased. The first and second wings 36 and 38 include first and second outer edges 40 and 42 which preferably are aligned within the same plane. The co-planar edges 40 and 42 of the wings 36 and 38 allow the wings 36 and 38 to function as a widened base for stabilizing the tool 20 when in use.

The overall depth of the channel 32, including the wings 36 and 38, should be sufficient to allow for passage of the rod through the channel 32. The overall depth of the channel 32 is measured from the deepest portion 34 of the channel 32 to the plane defined by the first and second edges 40 and 42.

It will be appreciated that the first and second wings 36 and 38 may be monolithically formed with the rod guiding member 22 to form an integral one-piece unit. It will also be appreciated that the first and second wings 36 and 38 may be separate pieces attached to the sides of the rod guiding member 22 by conventional connecting means such as welding. It will further be appreciated that the back end 30 of the rod guiding member 22 extends longitudinally beyond the wings 36 and 38.

A significant feature of the tool 20 is that the front end 28 of the rod guiding member 22 is tapered to define a tab member 44 that is preferably in longitudinal alignment with the deepest portion 34 of the rounded channel 32. The tab member 44 preferably includes a front edge 46 which is preferably traversely aligned with respect to the channel 32. The front edge 46 preferably has a width which is substantially more narrow than the width between the first and second outer edges 40 and 42 of the first and second wings 36 and 38. The tab member 44 also preferably includes a first tapered edge 48 flaring radially outward from the front edge 46 of the tab member 44 to the first outer edge 40 of the first wing 36. Similarly, the tab member 44 preferably includes a second tapered edge 50 flaring radially outward from the front edge 46 of the tab member 44 to the second outer edge 42 of the second wing 38.

It will be appreciated that the first and second tapered edges 48 and 50 preferably intersect the first and second outer edges 40 and 42 at first and second pivot points 52 and 54. In use, the tool 20 pivots about the first and second pivot points 52 and 54 relative to a form surface. It will also be appreciated that the first and second tapered edges 46 and 48 and the first and second wings 36 and 38 are preferably symmetrical about a longitudinal axis passing longitudinally through the rounded channel 32.

It will be appreciated that the degree of curvature of the rounded channel 32 may vary along the length of the rounded channel 32. For certain applications, it may be desirable for the portion of the rounded channel 32 located along the tab member 44 to have a greater degree of curvature than the remainder of the rounded channel 32. For example, for use in guiding a ⅝ inch rod, it may be desirable for the portion of the rounded channel 32 located along the tab member 44 to have a degree of curvature matching the arc swung by a 5/16 inch radius. In contrast, the remainder of the channel 32 may have a degree of curvature which matches the arc swung by a ⅜ inch radius. The variation in degrees of curvature provides greater rod clearance through the main portion of the channel 32 and provides a tight fit through the tab portion of the channel 32.

The tool 20 also preferably includes a handle 56 connected to the outer surface 24 of the rod guiding member 22. The handle 56 is preferably located adjacent to the back end 30 of the rod guiding member 22 and preferably extends in a second direction generally opposite from the first direction in which the rounded channel 32 opens. In a preferred embodiment, the handle 56 forms an 80 degree angle with respect to the rod guiding member 22. However, it will be appreciated that the handle 56 may be aligned at other angles with respect to the rod guiding member 22 without departing from the scope of the present invention.

The handle 56 preferably has a distal end 58 which is rounded to facilitate grasping the lever arm 56. The handle 56 also preferably includes a proximal end 60 which is preferably monolithically formed with a reinforcing member 62 that extends longitudinally along the outer surface 24 of the rod guiding member 22. The reinforcing member 62 prevents the rod guiding member 22 from bending with use. It will be appreciated that the reinforcing member 62 may be monolithically formed as a one-piece unit with the rod guiding member 22 or may be affixed to the outer surface 24 of the rod guiding member 22 by conventional connecting techniques such as welding.

The reinforcing member 62 preferably has a forward end 64 in general longitudinal alignment with the tab member 44. The forward end 64 forms a stop 66 which extends generally perpendicularly outward from the outer surface 24 of the rod guiding member 22. In use, the tab member 44 is inserted through a concrete tie loop such that the stop 66 engages the tie 76.

It will be appreciated that the tool 20 may be constructed of a material having strong and durable physical attributes. A common material having such attributes is steel.

Figure 4:
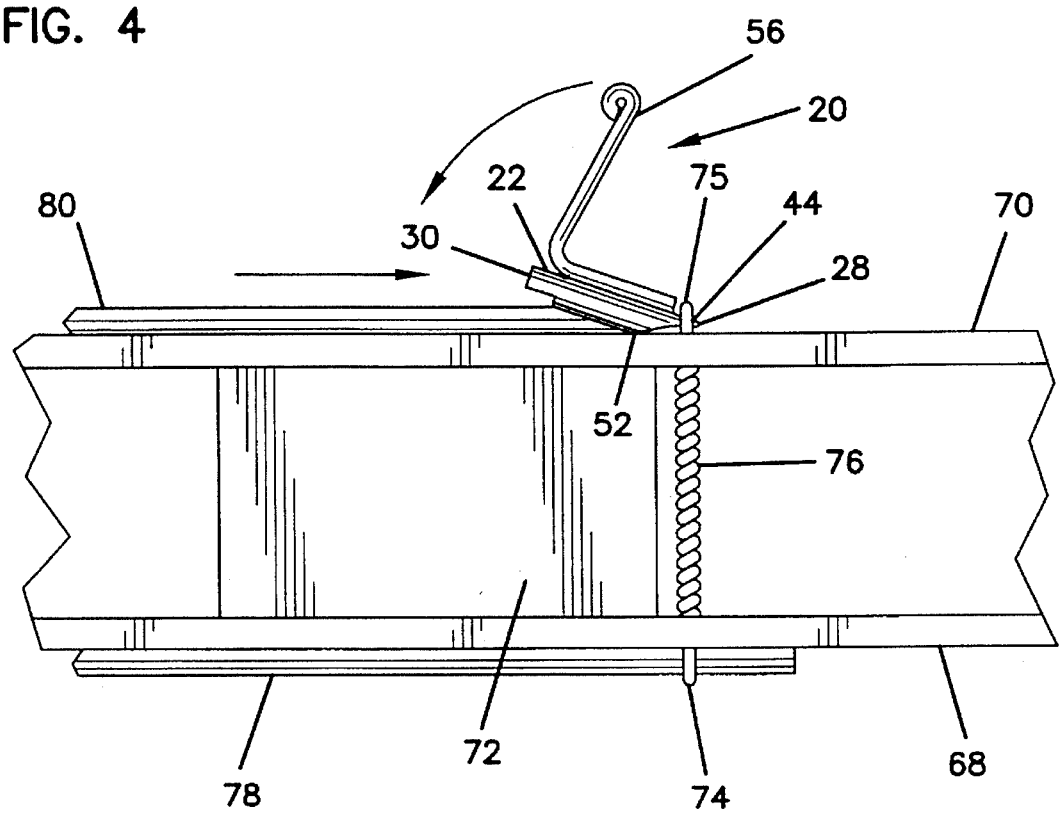
FIG. 4 is a schematic view of the tool of FIG. 1 showing the tool being used to guide a rod through a partially exposed tie loop.
Figure 5:
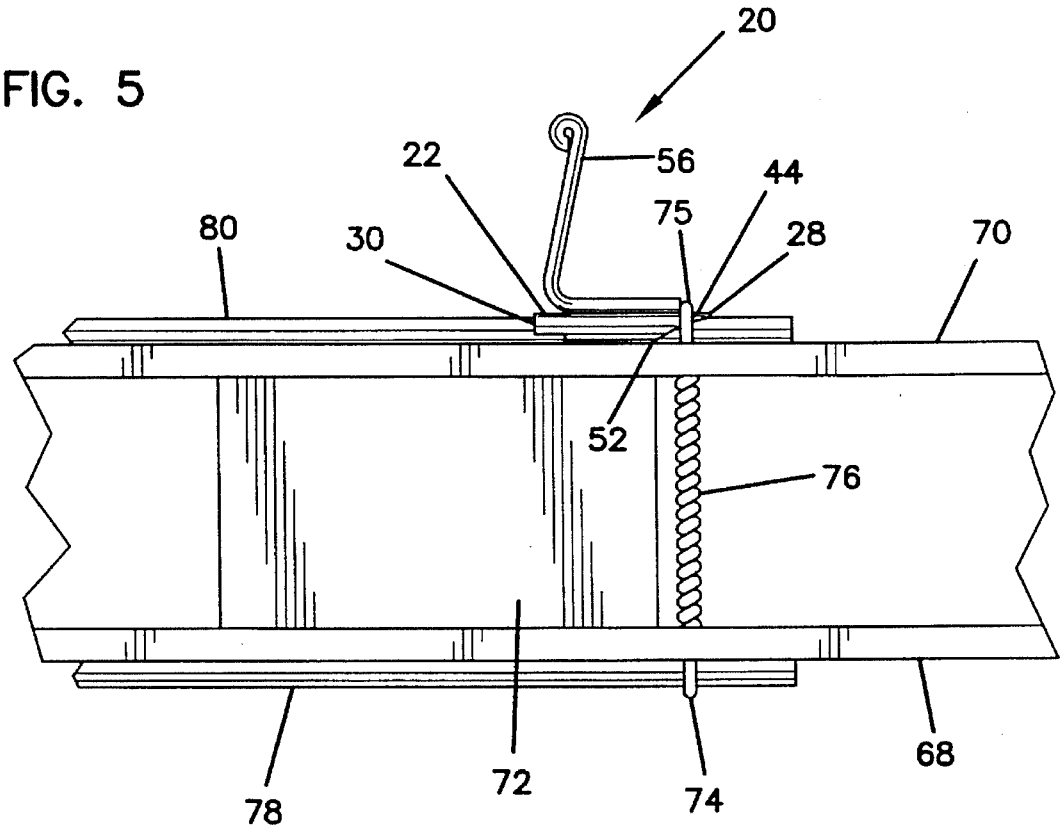
FIG. 5 is a schematic view of the tool of FIG. 1 showing the orientation of the tool when the tie loop has been pulled completely through a concrete form such that there is sufficient clearance to pass the rod through the loop.

FIGS. 4 and 5 schematically show how the tool 20 is used to guide rods through the loops of ties used to hold concrete forms together. FIGS. 4 and 5 show a front form 68 and a back form 70. A structure 72 such as framing for doors and windows, a stop for plumbing and electrical lines, a block-out, an end cap, or a spacer is positioned between the front form 68 and the back form 70.

In securing the front and back forms 68 and 70 together, the looped ends of ties 76 are inserted through slots in the front and back forms 68 and 70. Typically, a front loop 74 is first inserted through the front form 68 and held in place by a front rod 78. Because there is no tension on the tie 76, the front loop 74 can be completely inserted through the front form 68 thereby allowing the front rod 78 to be easily passed through the loop However, due to interference caused by the framing structure 72, a back loop 75 inserted within the slot in the back form 70 does not extend completely through the slot. Because the back loop 75 is only partially exposed, there is insufficient clearance for a back rod 80 to be passed through the back loop 75 of the tie 76.

In guiding the back rod 80 through the back loop 75 of the tie 76, the tab member 44 of the tool 20 is inserted through the portion of the loop 75 extending the beyond the back form 70. As inserted, the rod guiding member 22 is aligned at an oblique angle with respect to the back form 70 and the pivot points 52 and 54 are contacting the surface of the back form 70 (as shown in FIG. 4). While the handle is gripped, the back rod 80 is hammered or mauled longitudinally through the elongated rounded channel 32 of the tool 20 in a direction oriented from the back end 30 of the rod guiding member 22 toward the front end 28 of the rod guiding member 22. As the back rod 80 is moved through the rounded channel 32 toward the front end 28, the back rod 80 contacts the inner surface 26 of the rod guiding member 22 causing the rod guiding member 22 to pivot about the pivot points 52 and 54 such that the back end 30 of the rod guiding member 22 moves toward the back form 70 and the front end 28 of the rod guiding member 22 moves away from the back form 70.

As the rod guiding member 22 continues to pivot, the tab member 44 pulls the back loop 75 of the tie 76 through the back form 70. When the back rod 80 closely approaches the front end 28 of the rod guiding member 22, the rod guiding member 22 is caused to snap down against the back form 70 such that the first and second outer edges 40 and 42 of the first and second wings 36 and 38 are parallel to and flush against the surface of the back form 70 (as shown in FIG. 5). In such an orientation, the back loop 75 of the tie 76 is pulled completely through the back form 70 and engages the stop 66.

Once the tool 20 is in the snapped down position, the back rod 80 can be easily hammered through the rounded channel 32 and guided through the back loop 75 of the tie 76. Once the back rod 80 has been hammered through the back loop 74 of the tie 76, the tool 20 can be detached from the tie 76 by tapping the tool 20 with a hammer such that the tab member 44 is removed from the back looped end 75 of the tie 76.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. A tool comprising:

an elongated rod guiding member having outer and inner surfaces extending longitudinally between a front end and a back end, the inner surface of the rod guiding member being curved to form a rounded channel that opens in a first direction, the rounded channel having a deepest portion extending longitudinally between the front and back ends of the rod guiding member, and the front end of the rod guiding member having a taper defining a longitudinally extending tab member in longitudinal alignment with the deepest portion of the rounded channel; and a handle connected to the outer surface of the rod guiding member.

2. The tool of claim 1, wherein the handle is located generally adjacent to the back end of the rod guiding member and extends in a second direction generally opposite from the first direction in which the rounded channel opens.

3. The device of claim 2, further comprising a reinforcing member aligned longitudinally along the outer surface of the rod guiding member, wherein the handle is in unity with the reinforcing member.

4. The tool of claim 1, further including a stop extending outward from the outer surface at a location spaced from the front end of the tab member.

5. The tool of claim 1, further including wing members flaring from opposite sides of the rounded channel to form a base for stabilization.

6. A tool for guiding a rod through a tie loop which is extending through a slot in a concrete form, the tool comprising:

a rod guiding member having front and back ends, the rod guiding member defining an elongated channel extending longitudinally between the front and back ends of the rod guiding member, the channel being arranged and configured for longitudinally receiving and guiding the rod, the front end of the rod guiding member having a taper that forms a tab member sized for insertion through the tie loop, the rod guiding member also including means for pivoting relative to the concrete form as the rod is moved longitudinally through the channel of the rod guiding member, wherein as the rod guiding member pivots, the tab member pulls the tie loop through the slot in the concrete form thereby allowing the rod to be guided through the tie loop; and a handle connected to the rod guiding member for gripping the tool.

7. The device of claim 6, further comprising wing members flaring from opposite sides of the channel to form a widened base, wherein the wing members engage the concrete form to stabilize the tool when the rod is moved through the channel.

* * * * *